United States Patent [19]

Kahl

[11] 4,290,787

[45] Sep. 22, 1981

[54] BOTTOM-POWERED ELECTROSTATIC PRECIPITATOR

[75] Inventor: Melvin R. Kahl, Richland, Pa.

[73] Assignee: Envirotech Corporation, Menlo Park, Calif.

[21] Appl. No.: 148,846

[22] Filed: May 12, 1980

[51] Int. Cl.[3] ..... B03C 3/40

[52] U.S. Cl. ..... 55/120; 55/139; 55/146; 55/148

[58] Field of Search ..... 55/108, 117, 120, 139, 55/146, 148; 174/15 BH, 139, 211; 361/235

[56] References Cited

U.S. PATENT DOCUMENTS

| | | | |
|---|---|---|---|
| 1,362,128 | 12/1920 | Möller | 55/139 |
| 3,216,180 | 11/1965 | Cooper et al. | 55/117 |
| 3,733,784 | 5/1973 | Anderson et al. | 55/148 |
| 4,138,233 | 2/1979 | Masuda | 55/139 |

FOREIGN PATENT DOCUMENTS

| | | | |
|---|---|---|---|
| 488155 | 9/1924 | Fed. Rep. of Germany | 55/146 |
| 505796 | 11/1927 | Fed. Rep. of Germany | 55/146 |

*Primary Examiner*—David L. Lacey
*Attorney, Agent, or Firm*—Robert E. Krebs; T. J. McNaughton

[57] ABSTRACT

A high-voltage electrostatic precipitator is powered by a transformer supported below the high-voltage electrodes. A lead-in conductor extends from the transformer to the electrodes through a screen-covered aperture in the precipitator housing. Purging gas is directed through the aperture to prevent accumulation of particulates on the lead-in conductor.

3 Claims, 2 Drawing Figures

BOTTOM-POWERED ELECTROSTATIC PRECIPITATOR

BACKGROUND OF THE INVENTION

1. Field of the Invention

This invention pertains to means for applying electric power to corona-generating electrodes in an electrostatic precipitator.

2. State of the Prior Art

It has been customary to supply electric power to high-voltage corona-generating electrodes in an electrostatic precipitator from a step-up transformer supported on the roof of the precipitator. Thus, in the prior art, the lead-in conductor coupling the transformer to the high-voltage electrodes extended through the precipitator housing at a position above the high-voltage electrodes.

It was apparent in the prior art that bottom powering of the high-voltage electrodes of an electrostatic precipitator (i.e., locating the transformer at ground level or at the level of a hopper positioned on a platform below the electrodes to collect particulates falling from the electrodes) would simplify installation of the transformer. Bottom powering would also minimize structural loading on the precipitator housing, and would also provide easier access to the transformer and to the interior of the precipitator.

A transformer used to power an industrial electrostatic precipitator typically weighs from 3000 to 5000 pounds, and occupies about 70 cubic feet. Installation of such a transformer at ground level rather than on the roof of the precipitator (typically 50 to 150 feet above ground) would be advantageous in terms of manpower, time and equipment required to accomplish the installation. Furthermore, installation of a transformer at ground level would preclude the need for structural reinforcement of the precipitator housing, which would otherwise be necessary to support the transformer on the precipitator roof.

Access to a transformer for maintenance and repair would be easier, if the transformer were located at ground level rather than on the roof of an electrostatic precipitator. Access to the interior of the precipitator would also be facilitated if the transformer were located at ground level, because entry into a precipitator housing for maintenance purposes is not permitted by the usual safety regulations until visual confirmation has been made that the transformer has been electrically disconnected from the high-voltage electrodes. In accordance with customary safety procedures, keys for unlocking entry doors into the various interior regions of an electrostatic precipitator are kept on a key block located in the vicinity of the transformer in order to facilitate visual verification that the transformer has been disconnected from the high-voltage electrodes before entry into the precipitator housing can be made.

Despite the apparent advantages of bottom powering of an electrostatic precipitator, it was nevertheless deemed necessary in the prior art to locate the transformer at a level above the high-voltage electrodes in order to prevent the lead-in conductor for coupling power from the transformer to the electrodes from becoming coated with particulates removed from the gas stream passing through the precipitator. It was also deemed necessary in the prior art to locate the transformer at a level above the high-voltage electrodes in order to prevent a coating of particulate matter from forming on the insulators that isolate the high-voltage electrodes from electrically grounded components of the precipitator.

Prior to the present invention, no convenient and practicable way had been found for coupling a step-up transformer from a location below the high-voltage electrodes of an electrostatic precipitator to the high-voltage electrodes by means of a lead-in conductor that passes directly from the transformer to the electrodes through the bottom of the precipitator housing.

OBJECTS OF THE INVENTION

It is an object of the present invention to provide a bottom-powered electrostatic precipitator, wherein electric power is supplied to high-voltage electrodes of the precipitator from a transformer that is supported at ground level, or at a level at which particulate-collecting hoppers are located below the high-voltage electrodes.

It is a concomitant object of the present invention to provide electric power lead-in means for coupling power from a transformer to the high-voltage electrodes in a bottom-powered electrostatic precipitator.

It is a particular object of the present invention to prevent dust and particulates from accumulating on or in the region of a lead-in conductor for coupling electric power from a step-up transformer to the corona-generating electrodes of a bottom-powered electrostatic precipitator. Accumulation of dust and particulates in the region of the lead-in conductor is prevented by providing a continuous flow of purging air through the region. The purging air is drawn into the region of the lead-in conductor through an electrically non-conductive screen that is positioned over an aperture in the wall of the precipitator through which the lead-in conductor enters the precipitator.

DESCRIPTION OF PREFERRED EMBODIMENT

Figure 1:
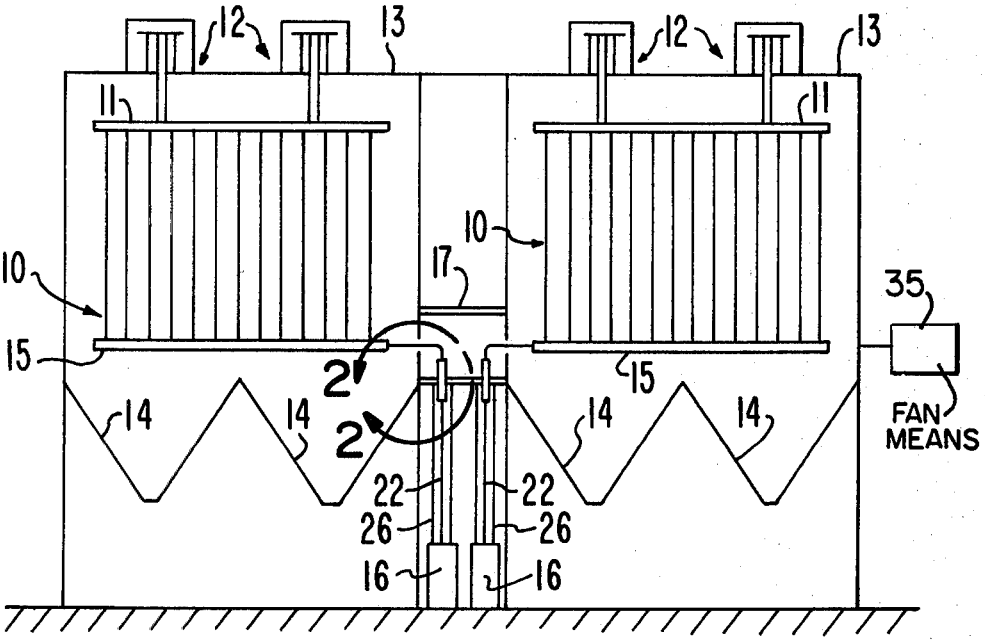
FIG. 1 is a schematic cross-sectional representation of a bottom-powered electrostatic precipitator according to the present invention.

In an electrostatic precipitator, vertically oriented corona-generating electrodes are typically attached to a support frame suspended from the precipitator roof. FIG. 1 provides a schematic representation of a battery of bottom-powered electrostatic precipitator modules, each module having such an arrangement of high-voltage corona-generating electrodes. Within each precipitator module, a plurality of high-voltage electrodes 10 are attached in a linear array by conventional means to a horizontal member 11 of an electrically conductive support frame. The horizontal member 11 assumes the electrical potential of the electrodes 10, and is secured to a roof portion 13 of the precipitator by a plurality of mounting assemblies 12. The mounting assemblies 12 may be of the kind described in greater detail in copending commonly assigned patent application Ser. No. 148,845 filed May 12, 1980.

In a typical electrostatic precipitator, there would be a plurality of horizontal members 11 arranged in parallel rows, with each horizontal member 11 having a plurality of spaced-apart corona-generating electrodes 10 attached thereto in a linear array. Each linear array of corona-generating electrodes 10 is positioned between a pair of parallel collector plate electrodes (not shown) that are maintained at ground potential. As a particulate-laden gas stream (e.g., flue gas from a coal-fired burner) passes between adjacent collector plates in the precipitator, the strong electric field near each of the high-voltage electrodes 10 causes ionization of the gas. This ionization process causes electric charge to be imparted to the particulates in the gas stream.

The electric field established between the high-voltage electrodes 10 and the grounded collector plates drives the charged particulates in the gas stream, according to the sign of their charge, toward either the high-voltage electrodes 10 or the grounded collector plates. With a negative voltage applied to the high-voltage electrodes 10, as is the usual arrangement in an industrial electrostatic precipitator, negatively charged particulates are drawn to the collector plates for deposition thereon, and any positively charged particulates present are attracted to the high-voltage electrodes 10. Electrophoretic forces due to non-uniformities in the electric field also act on the particulates, regardless of whether the particulates are charged or electrically neutral, and are also responsible for deposition of particulates on the electrodes. Periodically, the collector electrodes and the high-voltage electrodes 10 are mechanically rapped to dislodge accumulated particulates therefrom. The particulates rapped from the electrodes fall by gravity to hoppers 14 positioned under the electrodes to collect the particulates for eventual removal from the precipitator.

In accordance with the present invention, high-voltage electric power is applied to the corona-generating electrodes 10 from an electric bus 15 to which the bottom end of each of the electrodes 10 is secured. The high-voltage electrodes 10 are typically 0.105-mil diameter steel wires, and the bus 15 is typically a steel member. The electrode wires 10 are secured to the bus 15, preferably by welding. The bus 15, in addition to its function as an electrical conductor, also serves as a stabilizing member to maintain the electrodes 10 in vertical alignment parallel to the adjacent collector plates.

The bus 15 is electrically coupled to a step-up transformer 16 located outside the precipitator. Where two precipitator modules are arranged in parallel as indicated in FIG. 1, a separate transformer 16 is provided for each module. The transformers 16 for the two adjacent modules are supported side-by-side each other in the space between the two modules. A horizontal housing 17 extends between the two precipitator modules to cover and protect the high-voltage coupling components (as shown in greater detail in FIG. 2) that connect the buses 15 to their respective transformers 16. The transformer 16 for each precipitator module is located below the level of its corresponding bus 15, and is preferably supportd at ground level.

Figure 2:
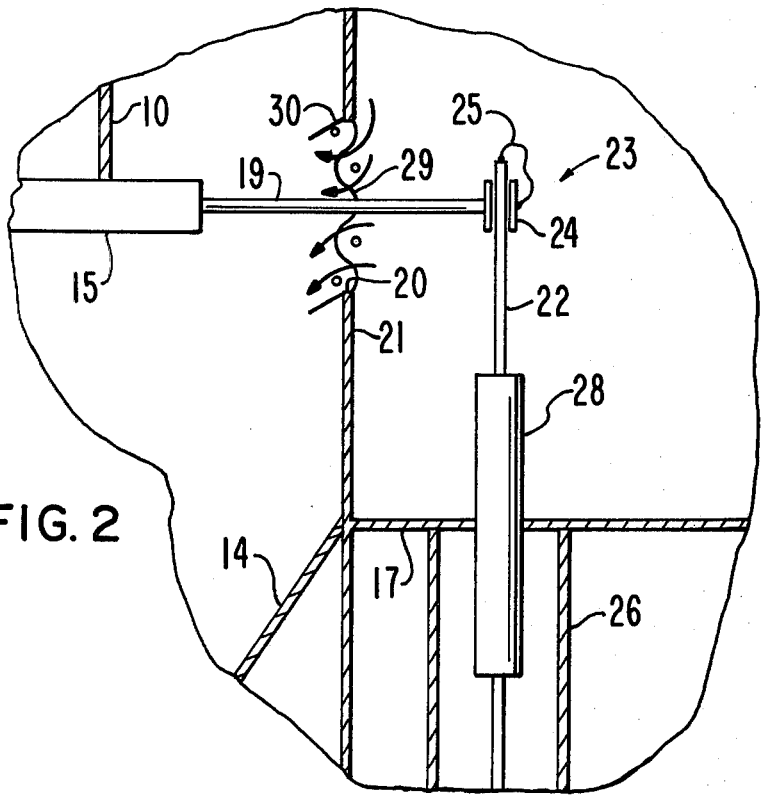
FIG. 2 is an enlarged fragmentary cross-sectional view of that portion of FIG. 1 included within line 2—2.

As indicated in FIG. 2, the high-voltage bus 15 of a precipitator module is electrically coupled to the step-up transformer 16 by means of a horizontal conducting rod 19 that extends out of the precipitator module from the bus 15 through an aperture 20 in a vertical wall portion 21 of the module. The horizontal connecting rod 19 is connected to a vertical conductor 22, which extends upward from the transformer 16 outside the precipitator module.

High-voltage coupling between the horizontal conducting rod 19 and the vertical conductor 22 is provided by means of a slip joint 23, which is designed to accommodate relative movement of the electrically conducting members 19 and 22 due to thermal-induced expansion and contraction, ground settling and other causes. The slip joint 23 may conveniently be formed by welding a hollow cylindrical electrically conductive pipe section 24 to the distal end of the horizontal conducting rod 19 outside the precipitator module, with the vertical conductor 22 being positioned to extend axially through the pipe section 24. Secure electrical contact between the vertical conductor 22 and the horizontal conducting rod 19 is provided by a stainless steel braided strap 25, one end of which is bolted or otherwise attached to the vertical conductor 22 and the other end of which is similarly attached to the pipe section 24 of the horizontal conducting rod 19.

The vertical conductor 22 is enclosed for most of its length within an electrically grounded metallic sleeve 26, which extends upward from the top of the transformer 16 through an aperture in the housing 17 for the high-voltage coupling components. A cylindrical insulating member 28 surrounds the portion of the vertical conductor 22 in the region where the conductor 22 passes through the aperture in the housing 17, and electrically isolates the conductor 22 from the housing 17.

The aperture 20 in the wall portion 21 of the precipitator module is covered with a dust screen 29 through which the horizontal conducting rod 19 extends out of the module. The dust screen 29 is electrically non-conductive, and is preferably made of a porous insulating material such as alumina or a high-temperature fabric. The dust screen 29 serves to prevent dust from entering into the precipitator module, and to prevent particulate matter from leaving the module. A dust baffle 30 surrounds the aperture 20 on the interior side of the wall portion 21, and serves to deflect particulates in the precipitator away from the dust screen 29. A constant flow of purging air is drawn through the aperture 20 by conventional means such as a fan 35 in order to prevent the accumulation of particulates in the vicinity of the lead-in conducting rod 19. The purging air also inhibits the build-up of a layer of dust and/or particulates on the screen 29, thereby assuring electrical isolation of the conducting rod 19 from the wall portion 21 of the precipitator module.

The present invention has been described above in terms of a particular embodiment, which is to be construed not in limitation of the invention but rather as a disclosure of the best mode presently contemplated by the inventor for carrying out his invention. The scope of the invention is defined by the following claims and their equivalents.

What is claimed is:

1. An electrostatic precipitator comprising a housing structure enclosing an array of elongate corona-generating electrodes, an upper end of each corona-generating electrode being attached to means for suspending said electrode within said housing structure, a lower end of each corona-generating electrode being attached to an electrically conductive means for applying electric power to said corona-generating electrodes, said electrically conductive means including a lead-in conductor extending outside said precipitator through an aperture in said housing structure to a step-up transformer, said transformer being supported at a level lower than said array of corona-generating electrodes, means for providing a flow of purging gas through said aperture into said housing structure during precipitator operation in order to inhibit accumulation of particulates on said lead-in conductor; and a screen member covering said aperture to prevent accumulation of particulates on said lead-in conductor.

2. The electrostatic precipitator of claim 1 wherein said lead-in conductor makes electrical contact with a high-voltage lead extending from said transformer, said electrical contact occurring at a mechanical slip-joint outside said housing structure.

3. The electrostatic precipitator of claim 1 wherein a baffle structure is mounted inside said housing structure circumjacent said aperture to inhibit deposition of particulates on said screen member.

* * * * *